US007140947B2

(12) United States Patent
Nishimura et al.

(10) Patent No.: US 7,140,947 B2
(45) Date of Patent: Nov. 28, 2006

(54) BARREL POLISHING METHOD AND BARREL POLISHING APPARATUS

(75) Inventors: Kazutoshi Nishimura, Nishikasugai-Gun (JP); Takao Ishida, Nishikasugai-Gun (JP); Yoshihiro Masuda, Nishikasugai-Gun (JP)

(73) Assignee: Sintobrator, Ltd., Nagoya (JP)

( * ) Notice: Subject to any disclaimer, the term of this patent is extended or adjusted under 35 U.S.C. 154(b) by 0 days.

(21) Appl. No.: 11/135,601

(22) Filed: May 23, 2005

(65) Prior Publication Data

US 2006/0116053 A1 Jun. 1, 2006

Related U.S. Application Data

(63) Continuation of application No. PCT/JP03/11952, filed on Sep. 19, 2003.

(30) Foreign Application Priority Data

Nov. 29, 2002 (JP) ..... 2002-346870

(51) Int. Cl.
*B24B 1/00* (2006.01)
*B24B 49/00* (2006.01)

(52) U.S. Cl. ..... 451/10; 451/11; 451/12; 451/32; 451/35; 451/327; 451/328

(58) Field of Classification Search ..... 451/32, 451/35, 326, 327, 328, 9, 10, 11, 12
See application file for complete search history.

(56) References Cited

U.S. PATENT DOCUMENTS

| | | | | |
|---|---|---|---|---|
| 4,747,695 | A * | 5/1988 | Schmidt | 366/291 |
| 5,476,415 | A * | 12/1995 | Nishimura et al. | 451/326 |
| 6,764,384 | B1 * | 7/2004 | Kleer et al. | 451/32 |
| 6,899,605 | B1 * | 5/2005 | Lutz | 451/104 |
| 2003/0027509 | A1 * | 2/2003 | Gegenheimer | 451/326 |

FOREIGN PATENT DOCUMENTS

| | | | |
|---|---|---|---|
| JP | 50-8238 | B1 | 4/1975 |
| JP | 54-074590 | A1 | 6/1979 |
| JP | 57-194872 | A1 | 11/1982 |
| JP | 362099069 | * | 5/1987 |
| JP | 2000-015553 | A1 | 1/2000 |

* cited by examiner

*Primary Examiner*—Eileen P. Morgan
(74) *Attorney, Agent, or Firm*—Burr & Brown

(57) ABSTRACT

Barrel polishing is effected while causing a mass (M) consisting of work and media (polishing material) to rotation-flow by rotating a rotary disk installed in the bottom of a polishing tank by a drive motor. A load on the drive motor for the rotary disk is preset as by a load current value, and the flow of the mass (M) in the polishing tank is controlled, thereby effecting polishing while maintaining the load on the drive motor within the preset range.

8 Claims, 12 Drawing Sheets

BARREL POLISHING METHOD AND BARREL POLISHING APPARATUS

CROSS REFERENCE TO RELATED APPLICATIONS

This application is a continuation of International Application No. PCT/JP2003/011952, filed Sep. 19, 2003, which designated the United States, and also claims the benefit of Japanese Application No. 2002-346870, filed Nov. 29, 2002, the entireties of which are incorporated herein by reference.

FIELD OF THE INVENTION

The present invention relates to a flow barrel polishing method and a flow barrel polishing apparatus for polishing a workpiece while causing a mass configured by the workpiece and a media to centrifugally flow in a polishing bath.

BACKGROUND OF THE INVENTION

Flow barrel polishing is a method for inputting a mass configured by a workpiece that is a polishing target and a media that is a polishing material into a polishing bath, and for polishing the workpiece while causing the mass to centrifugally flow using a rotary disc provided on a bottom of the polishing bath. One example of the method is disclosed in Japanese Patent Application Laid-Open No. 8-11057 (Japanese Patent Number 3343701). As shown in FIG. 1, according to this flow barrel polishing method, the workpiece and the media are rubbed against each other to polish the workpiece surface while the mass is caused to flow in a toroidal fashion by a combination of a horizontally rotatable flow running along a rotation direction of the rotary disc and a vertically rotatable flow rising along an inner wall surface of the polishing bath and running downward in a central direction when reaching an uppermost portion by a centrifugal force.

The conventional flow barrel polishing has, however, disadvantages in that the media is gradually worn as the polishing progresses, a mass amount is reduced, a frictional force between the workpiece and the media is reduced, and a deterioration in a polishing capability is thereby unavoidable. These disadvantages are conspicuous particularly in dry flow barrel polishing.

SUMMARY OF THE INVENVTION

It is an object of the present invention to provide a flow barrel polishing method and a barrel polishing apparatus that can solve the above-stated conventional disadvantages, that can avoid a reduction in a polishing capability following progress of polishing, and that can greatly improve the polishing capability as compared with that of the conventional polishing method or apparatus.

The inventors of the present invention exerted their utmost efforts for solving the conventional disadvantages. As a result, the inventors discovered that the polishing capability can be considerably enhanced as compared with the conventional polishing capability by controlling a flow of a mass rising along an inner wall of a polishing bath using an appropriate means against a conventional common knowledge that the polishing capability of the flow barrel polishing is deteriorated when a natural flow of the mass is disturbed. Further, a change in the polishing capability of the flow barrel polishing apparatus appears as a change in a work amount transmitted from the rotary disc to the mass, that is, appears as a change in a rotation resistance of the rotary disc. It is, therefore, possible to grasp the change in the polishing capability of the apparatus as a load of a driving motor for the rotary disc from outside. Accordingly, by controlling the flow of the mass to keep the load of the driving motor for the rotary disc constant, the polishing capability deteriorated as the polishing progresses can be kept constant.

A barrel polishing method according to the present invention achieved based on the above-stated knowledge is a barrel polishing method for polishing a mass while causing the mass to rotatably flow by a rotary disc provided on a bottom of a polishing bath, characterized in that a load range of a driving motor for the rotary disc is set in advance, a flow area of the mass within the polishing bath is controlled with a load of the driving motor used as a parameter if the load of the driving motor is out of a set range, and the mass is polished while keeping the load of the driving motor within the set range. In this case, it is preferable to use, for example, a load current of the driving motor as the load of the driving motor.

According to the present invention, the flow area of the mass within the polishing bath can be controlled by various methods including a method for elevating movable means that covers an upper portion of the polishing bath and increasing or reducing the flow area of the mass that rises along an inner wall of the polishing bath, a method for increasing or reducing a force of pressing down an upper end the mass that rises along the inner wall of the polishing bath, a method for controlling a rotation speed of the rotary disc, and the like. Further, the load current set range is not always limited to one and a plurality of load current set ranges can be set at predetermined time intervals. By intermittently controlling the flow of the mass within the polishing bath, polishing of the mass while controlling the flow of the mass and free polishing without a control over the flow of the mass can be alternately and repeatedly performed.

Further, a barrel polishing apparatus according to the present invention is characterized by comprising: a polishing bath into which a workpiece and a media are input; a rotary disc, provided on a bottom of the polishing bath, for causing the workpiece and the media to rotatably flow to thereby form a mass within the polishing bath; means for setting a load of a driving motor for the rotary disc; and flow area control means for controlling a flow area of the mass within the polishing bath with the load of the driving motor used as a parameter if the load of the driving motor is out of a set range.

As the mass flow area control means, any of various means including a combination of movable means provided in an upper portion of the polishing bath and an elevation mechanism for the movable means, a combination of movable means provided in an upper portion of the polishing bath and a pressurization chamber that supplies or discharges a pressurized fluid and that thereby moves the movable means downward or stops moving the movable means downward, a combination of movable means that is provided in an upper portion of the polishing bath and that is expandable and compressible within the polishing bath and a pressurization mechanism that expands or compresses the movable means, control means for controlling a rotation speed of the driving motor for the rotary disc, and the like can be used. Each of these control means can be employed together with the other control means.

According to the present invention, the load range of the driving motor for the rotary disc is set in advance as a load current or the like, and the flow area of the mass within the polishing bath is controlled with the load of the driving motor used as a parameter if the load of the driving motor is out of the set range, whereby the mass is polished within the load set range. A deterioration in polishing capability following progress of the polishing can be detected as a reduction in the load of the driving motor for the rotary disc as a result of a reduction in the frictional force between the workpiece and the media due to a reduction in a volume of the mass after wearing of the media or polishing of the workpiece. Therefore, if the load is reduced, then the flow area of the mass within the polishing bath is narrowed to keep the frictional force between the workpiece and the media constant, and the load of the driving motor is always kept within the set range, whereby the barrel polishing can be performed while keeping the polishing capability constant. Besides, by area control of the flow of the mass within the polishing bath, the frictional force between the workpiece and the media can be considerably intensified as compared with that of the conventional method or apparatus. While these advantages of the present invention are conspicuous particularly in dry barrel polishing, they are similarly exhibited even in wet barrel polishing.

DETAILED DESCRIPTION OF THE INVENTION

First Embodiment: Movable Means and Elevation Mechanism

Figure 1:
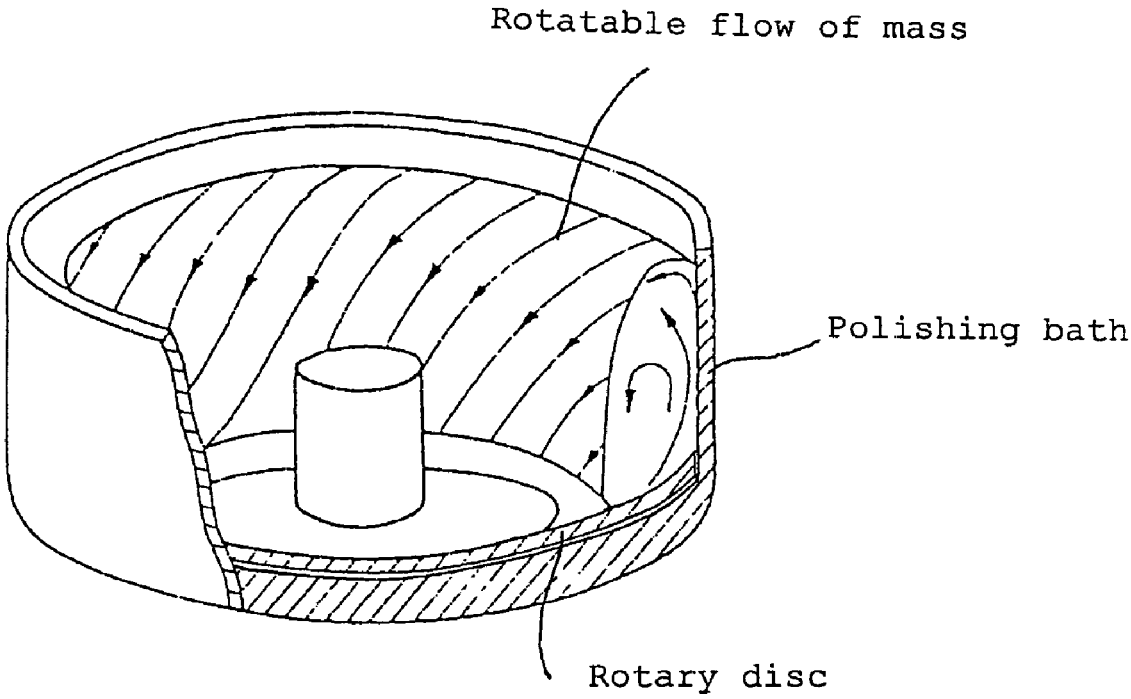
Fig. 1 Prior Art
FIG. 1 is a perspective view that depicts a flow of a mass in conventional flow barrel polishing.
Figure 2:
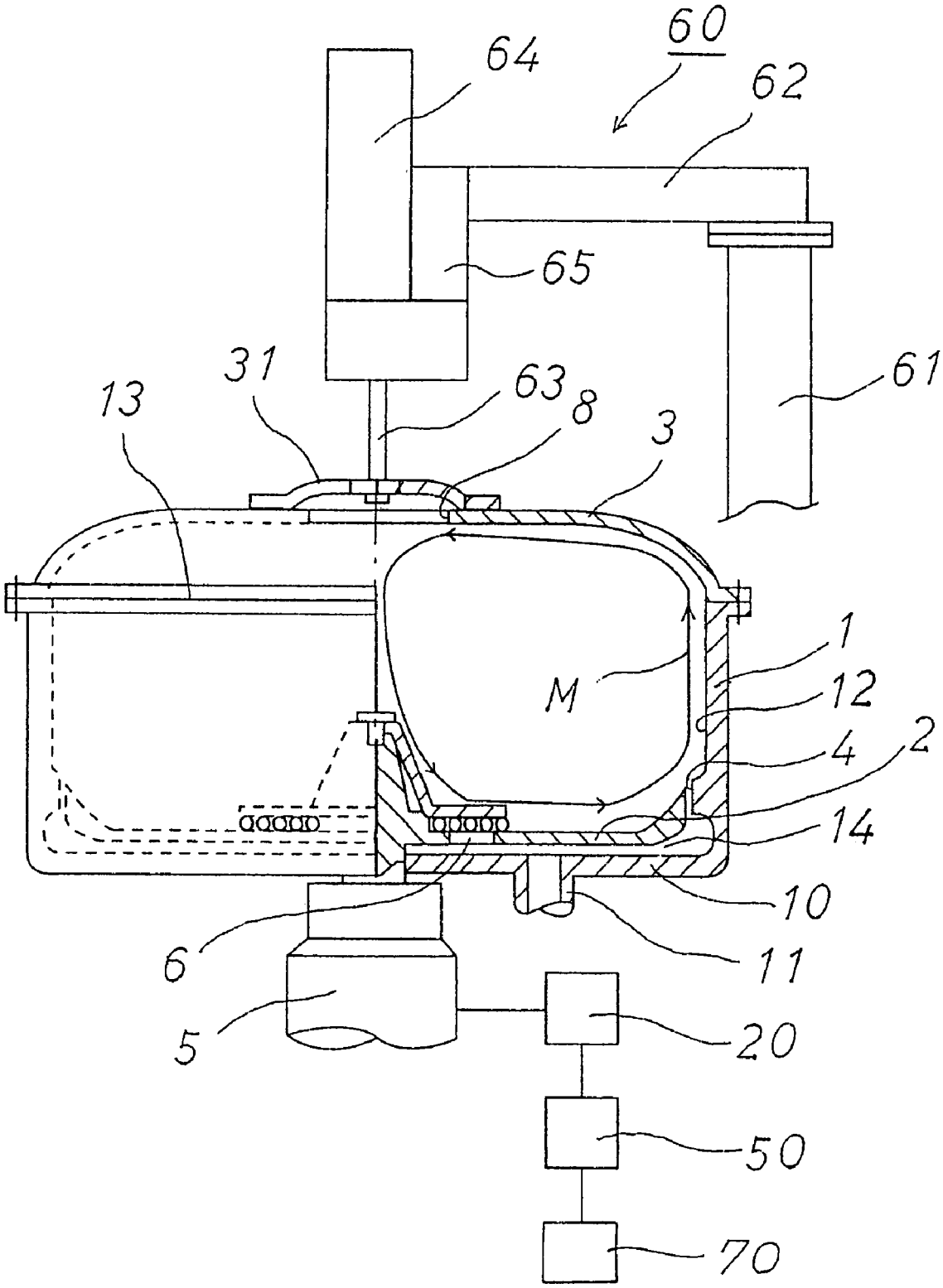
FIG. 2 is a partial cross-sectional view that depicts a first embodiment of the present invention.

FIG. 2 depicts a dry flow barrel polishing apparatus according to a first embodiment of the present invention. In FIG. 2, reference number 1 depicts a polishing bath into which a mass M configured by a workpiece and a media is input, and 2 denotes a plate-like rotary disc provided on a bottom of the polishing bath. The rotary disc 2 has a peripheral edge curved upward so that the mass M can easily flow upward. An antifriction lining consisting of urethane rubber or the like is applied to a portion in which the polishing bath 1 contacts with the mass M on the rotary disc 2. Reference 3 denotes a movable means that consists of a flexible material such as rubber for closing an upper opening 13 of the polishing bath 1. According to this embodiment, the movable means 3 is of a lid shape and has a peripheral portion fixed to an upper end of the polishing bath 1. As shown in FIG. 2, the peripheral edge of this movable means 3 is preferably curved to contact with an inner wall of the polishing bath 1. A height of the polishing bath 1 is set smaller than a maximum height at which the mass M freely flows centrifugally so that the upper end of the mass M that flows centrifugally can be controlled by the movable means 3.

The rotary disc 2, which is arranged slightly upward of a bottom plate 10 of the polishing bath 1, is rotated by a driving motor 20 through a reducer 5 while slidably contacting with the inner wall 12 of the polishing bath 1 with a slidable contact clearance 4 left. A rotation speed of the driving motor 20 is controlled by a control means 50.

The rotary disc 2 is provided with small bores 6 and a cavity 14 is formed between the rotary disc 2 and the bottom plate 10 of the polishing bath 1. A dust collector, not shown, is connected to a dust collection tube 11 provided in a lower portion of the cavity 14. Dusts generated by polishing are passed through the cavity 14 via the small bores 6 and the slidable contact clearance 4, and collected by this cavity 14 via the dust collection tube 11.

The load of the driving motor 20 for the rotary disc 2 is always detected by a load detection means included in the control means 50. Although it is practical to use a load current for detecting the load of the driving motor 20, the present invention is not always limited to this and a load power, for example, may be detected. According to the present invention, the load current or the like can be set by a load setting means 70 in advance, and the flow area of the mass M within the polishing bath 1 is controlled by a flow area control means of any one of various types as will be described later in detail. The polishing is thereby always performed within a set range of setting the load of the driving motor 20.

An opening 8 for evading a part of the mass M and providing a smooth flow when the mass M is filled into the polishing bath 1 and the flow of the mass M is not smooth is formed at a center of the movable means 3. In this embodiment, a support member 31 that strides over the opening 8 is fixedly provided. An elevation mechanism 60 for vertically moving this movable means 3 is provided above the movable means 3. The elevation mechanism 60 is configured by an arm 62 horizontally rotatably attached to an axis of a column 61, a driving section 64 that is attached to a tip end of the arm 62 and that vertically moves the movable means 3 through an operation rod 63 protruding upward of the support member 31 of the movable means 3, and a control section 65 that is included in the speed control means 50, that receives a signal from the load current detection means, and that drives the driving section 64. As the driving section 64, an appropriate type of the driving section 64 such as a hydraulic cylinder type or a ball screw type can be employed. In this embodiment, flow area control means for controlling the flow of the mass within the polishing bath 1 is constituted by the movable mean 3 and the elevation mechanism 60.

When the workpiece and the media are input into the polishing bath 1 and the rotary disc 2 is rotated by the driving motor 20, the workpiece and the media form the mass M and the mass M rises along the inner wall 12 of the polishing bath 1 by the centrifugal force as stated above. According to the present invention, the mass M flows in a toroidal fashion while a flow area of the rising mass M is restricted by the movable means 3 and a flow direction thereof is changed to a direction of the center of the polishing bath 1. It is a conventional common knowledge that when a natural flow of the mass is disturbed, the polishing capability of the flow barrel polishing is deteriorated. According to the present invention, however, the flow area of the mass that rises along the inner wall of the polishing bath is controlled by the appropriate means, thereby considerably increasing the frictional force between the workpiece and the media and greatly enhancing the polishing capability as compared with the conventional apparatus or method.

As stated, as the polishing progresses, corners (convex portions) of the media are worn and the workpiece is polished. Due to this, the frictional force between them is reduced and the polishing capability is gradually lessened. According to this embodiment, however, the elevation mechanism 60 that is the mass flow area control means moves the movable means 3 downward so that the load of the driving motor 20 is kept within the range set by the setting means 70 in advance.

Figure 3:
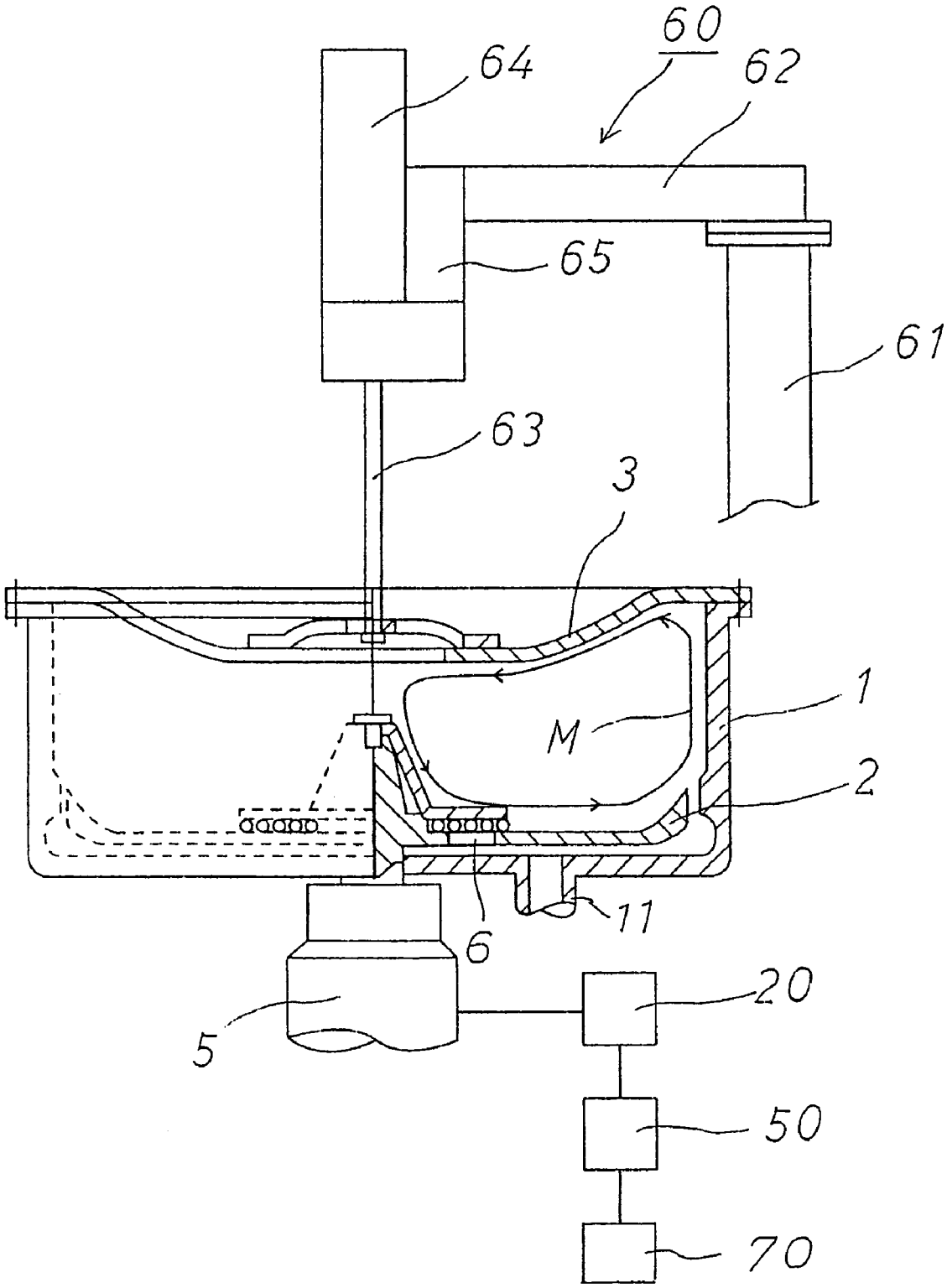
FIG. 3 is a partial cross-sectional view that depicts a state in which a movable means is moved downward according to the first embodiment of the present invention.

That is, if the polishing capability is deteriorated, the load of the driving motor 20, e.g., the load current is reduced. Therefore, in response to the signal from the load detection means included in the control means 50, the control section 65 of the elevation mechanism 60 moves the operation rod 63 downward as shown in FIG. 3. By thus bending the central portion of the movable means 3 downward, the upper portion of the mass M that rotatably flows is pressed down, the flow area of the mass M is reduced, a rising force of the mass M is converted into a pressurization force, and a pressure applied to the mass M is increased. As a result, the frictional force between the workpiece and the mass is increased, so that the polishing capability deteriorated as the polishing progresses can be recovered. In addition, the load of the driving motor 20 is recovered. When the operation rod 63 is moved downward and the load of the driving motor 20 reaches a preset upper limit, the control means 50 transmits a signal to stop moving down the operation rod 63 to the control section 65. The load of the driving motor 20 can be, therefore, recovered to an optimum value.

As can be seen, according to this embodiment, the polishing is performed while controlling the frictional force between the workpiece and the media to always fall within the certain range by optimally adjusting the height of the movable means 3 with the load of the driving motor 20 used as a parameter. It is, therefore, possible to continuously perform barrel polishing without deteriorating the polishing capability even if the polishing progresses.

After the polishing is finished, the movable means 3 is raised upward of the polishing bath 1 by the elevation mechanism 60 and the arm 62 is then rotated horizontally about the column 61. Next, the polishing bath 1 is rotated so that the bath 1 stands and the rotary disc 2 is rotated at a right angle or more, whereby the mass M completed with the polishing can be easily taken out from within the polishing bath 1.

Second Embodiment: Modification of Movable Means and Elevation Mechanism

Figure 4:
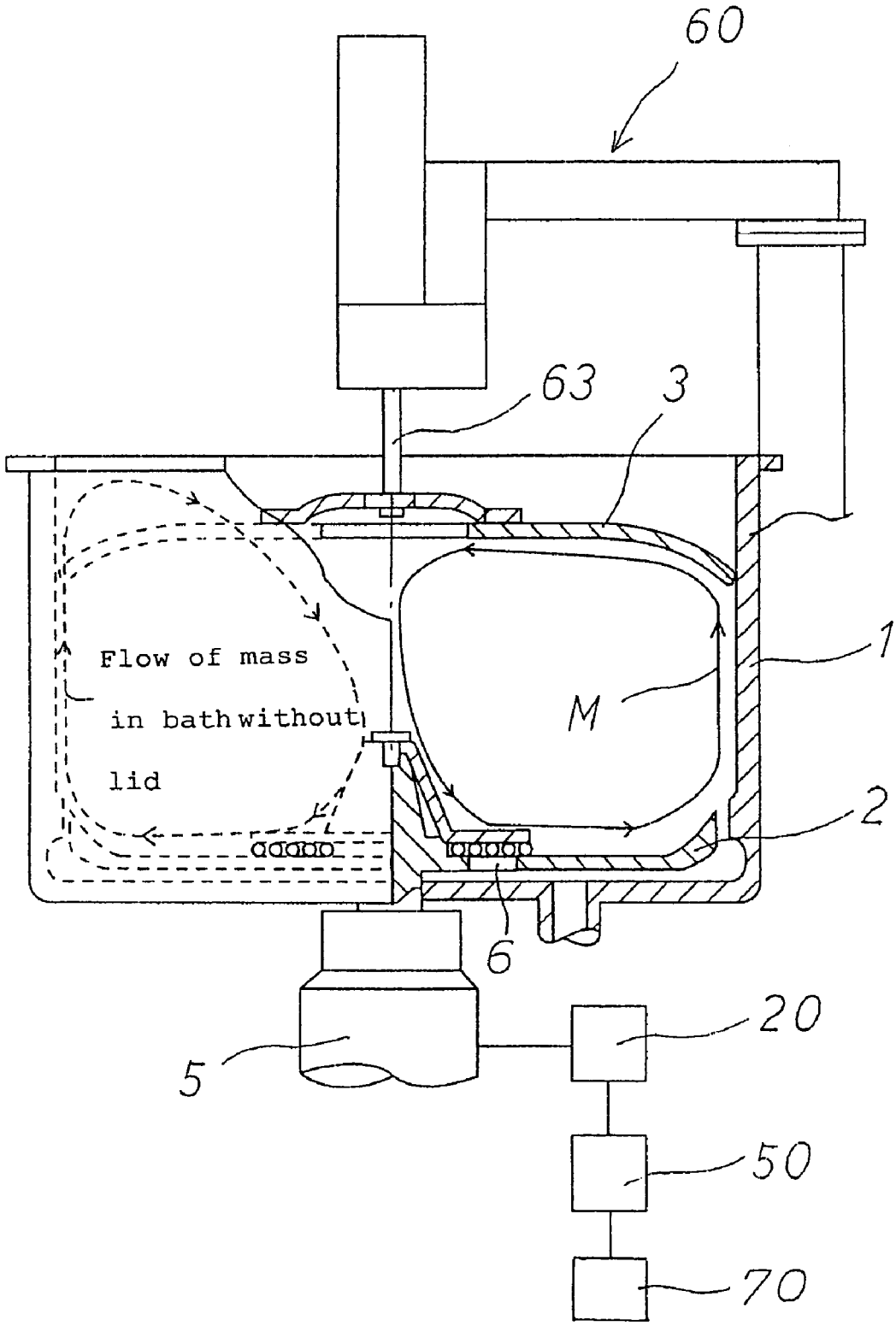
FIG. 4 is a partial cross-sectional view that depicts a second embodiment of the present invention.

In the first embodiment, the peripheral edge of the flexible movable means 3 is fixed to the upper end of the polishing bath 1. Alternatively, as shown in FIG. 4, the movable means 3 may consist of a rigid material such as metal, and may be provided so as to be able to be vertically slid within the polishing bath 1 by the elevation mechanism 60 working with the load of the driving motor 20. In this case, an outside diameter of the movable means 3 is set slightly smaller than an inside diameter of the polishing bath 1. In a left half part of FIG. 4, a free flow path of the mass M for the conventional apparatus without the movable means 3 is indicated by a broken line. In this second embodiment, similarly to the first embodiment, the upper portion of the mass M that rotatably flows is suppressed by the movable means 3, the reduced polishing force can be recovered.

Third Embodiment: Movable Means and Pressurization Mechanism for Movable Means

Figure 5:
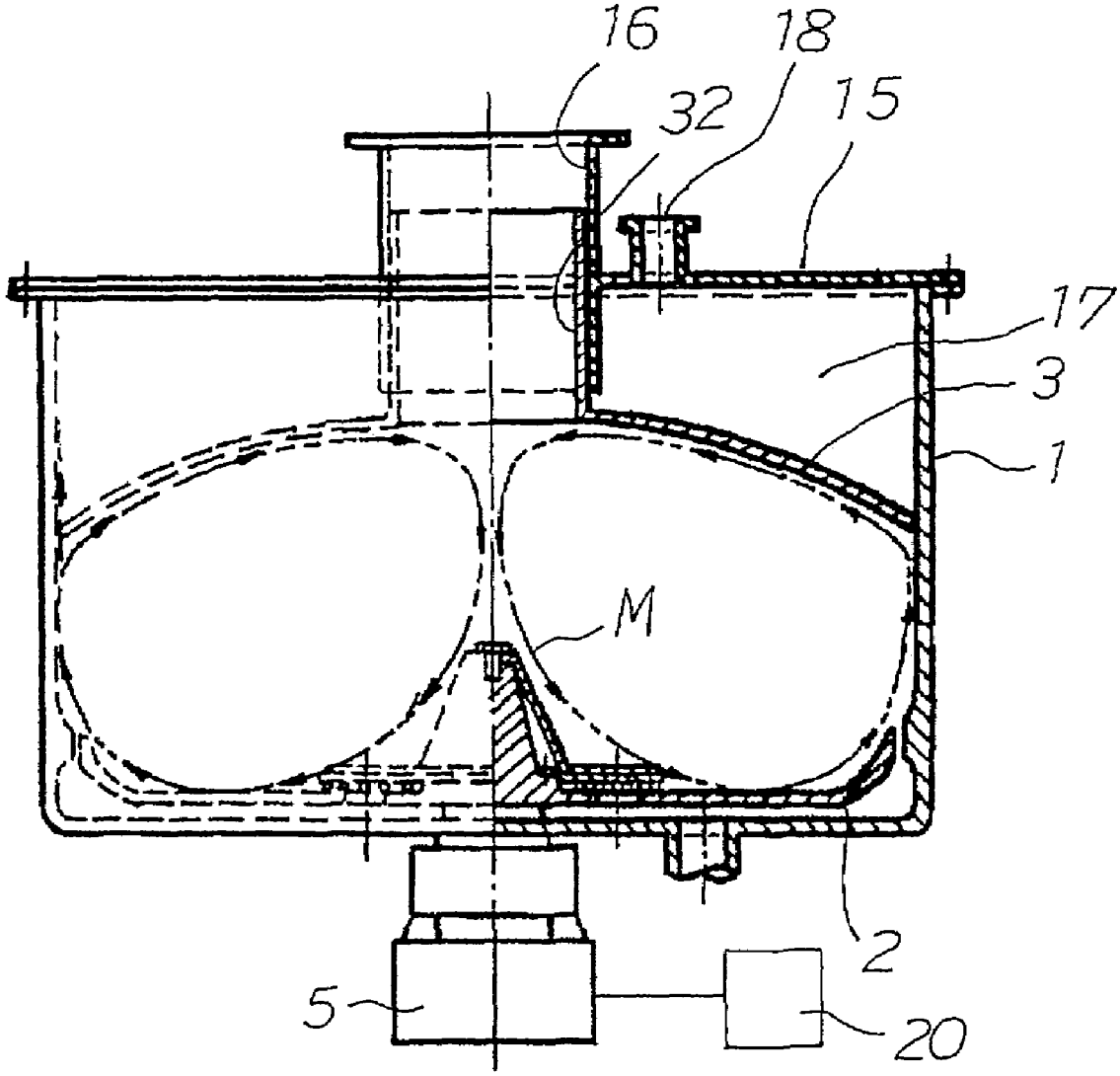
FIG. 5 is a partial cross-sectional view that depicts a third embodiment of the present invention.

FIG. 5 depicts a third embodiment of the present invention. In FIG. 5, a movable means 3 having an opening cylinder 32 provided at its center is slidably provided within a polishing bath 1. In addition, an outer cylinder 16 into which this opening cylinder 32 can be slidably fitted is provided on an upper lid 15 of the polishing bath 1. An annular pressure chamber 17 is formed between the upper lid and the movable means 3, and a pressurized fluid such as a compressed air is supplied from a pressurized fluid supply port 18 provided in the upper lid 15 to thereby pressurize the movable means 3 downward.

In this embodiment, a pressure of the pressurized fluid supplied from the pressurized fluid supply port 18 is increased and the movable means 3 is pressed downward in a piston manner when a load of a driving motor 20 is reduced, thereby controlling a flow area of a mass M. It is thereby possible to increase a frictional force between a workpiece and a medium and always perform barrel polishing within a set range of setting the load of the driving motor 20.

Figure 6:
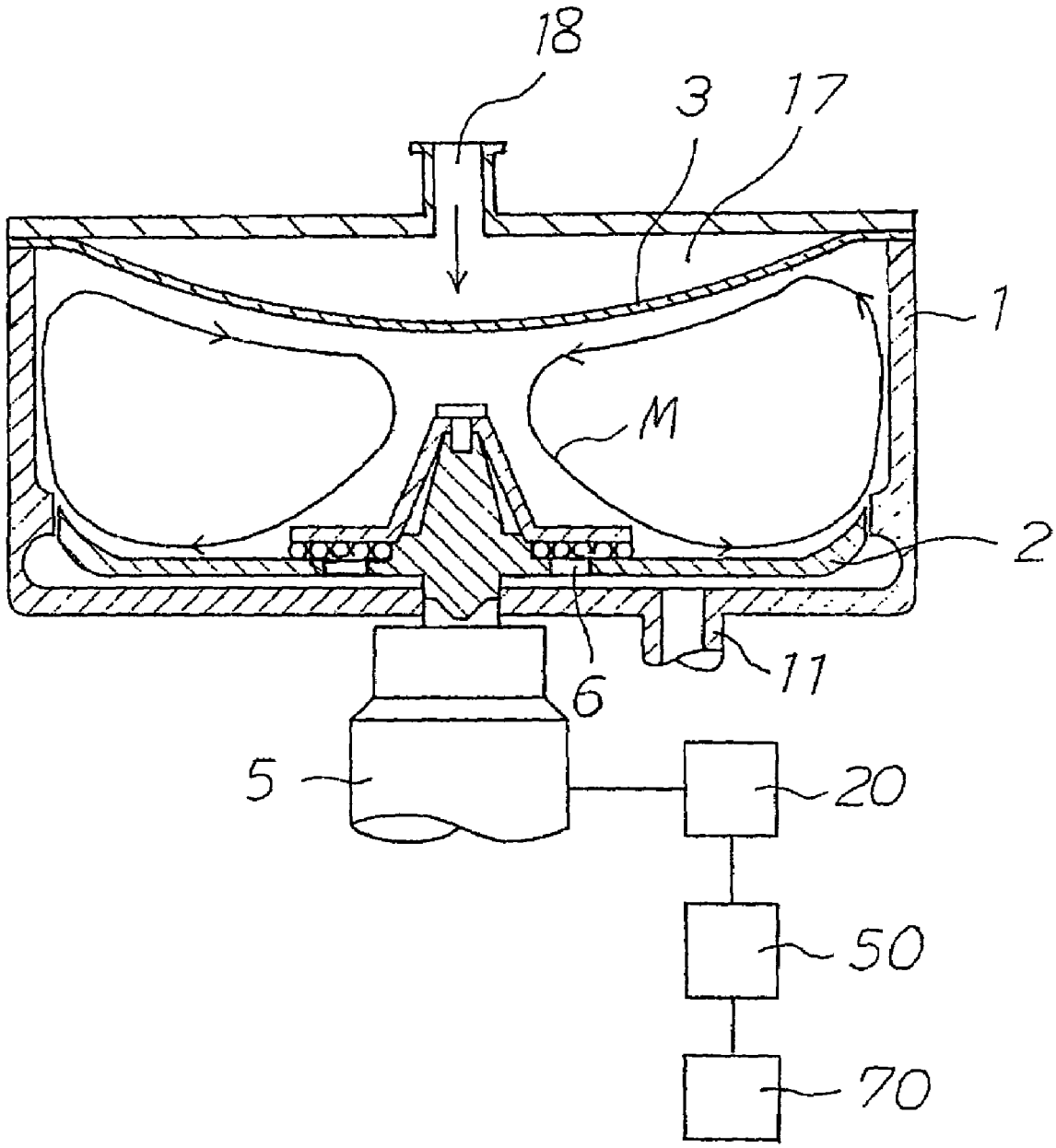
FIG. 6 is a partial cross-sectional view that depicts a modification of the third embodiment of the present invention.

Alternatively, as shown in FIG. 6, an expandable and compressible movable means 3 consisting of an elastic material such as rubber may be provided in an upper portion of the polishing bath 1, and the pressurized fluid such as the compressed air may be supplied from a pressurization and depressurization mechanism, not shown, via the pressurized fluid supply port 18 provided in the upper lid 15 to the pressure chamber 17 located above the movable means 3. By doing so, the movable means 3 can be expanded and compressed like a balloon. Thanks to such a structure, the flow area of the mass M can be controlled and the barrel polishing can be always performed within the set range of the load of the driving motor 20.

Fourth Embodiment: Modification of Movable Means by Suction

Figure 7:
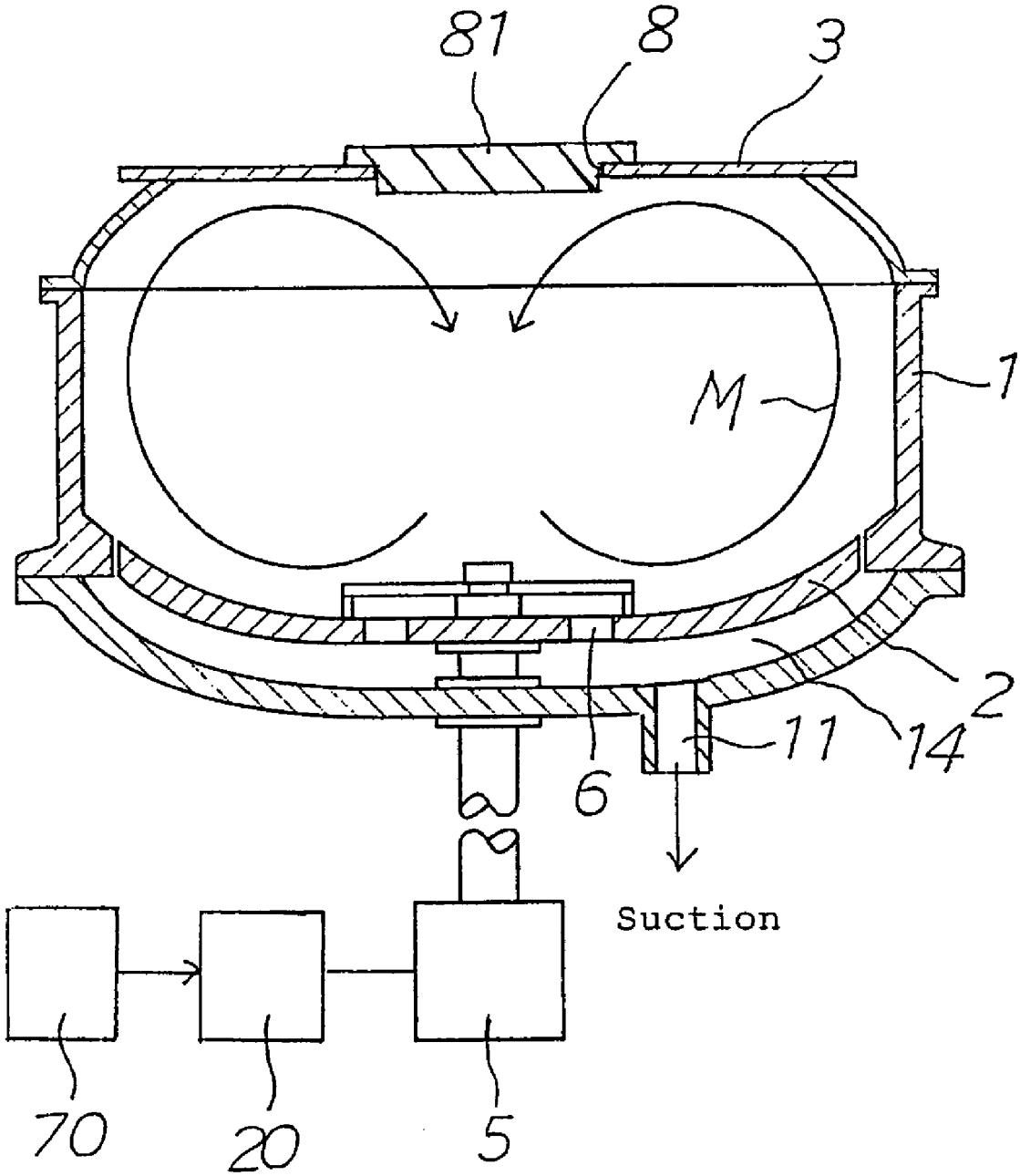
FIG. 7 is a partial cross-sectional view that depicts a fourth embodiment of the present invention.

FIG. 7 depicts a fourth embodiment of the present invention. In FIG. 7, a movable means 3 consists of a flexible material such as rubber and is fixed to an upper end surface of a polishing bath 1. If an opening 8 is formed at a center of the movable means 3, another sealing lid 81 is provided so as to be able to close the opening 8. A dust collection tube 11 is connected to a suction means, such as a dust collector, having an adjustable suction force. When a load of a driving motor 20 is reduced, an internal pressure of the polishing bath 1 is reduced to be lower than an atmospheric pressure, thereby bending the flexible movable means 3 toward an interior of the polishing bath 1 and narrowing a flow area of a mass M. A method for deforming the movable means 3 toward the interior of the polishing bath 1 and controlling the flow area of the mass M as stated above can keep the load of the driving motor 20 to fall within a set range, similarly to the preceding embodiments.

Fifth Embodiment: Pressurization by Weight of Movable Means

Figure 8:
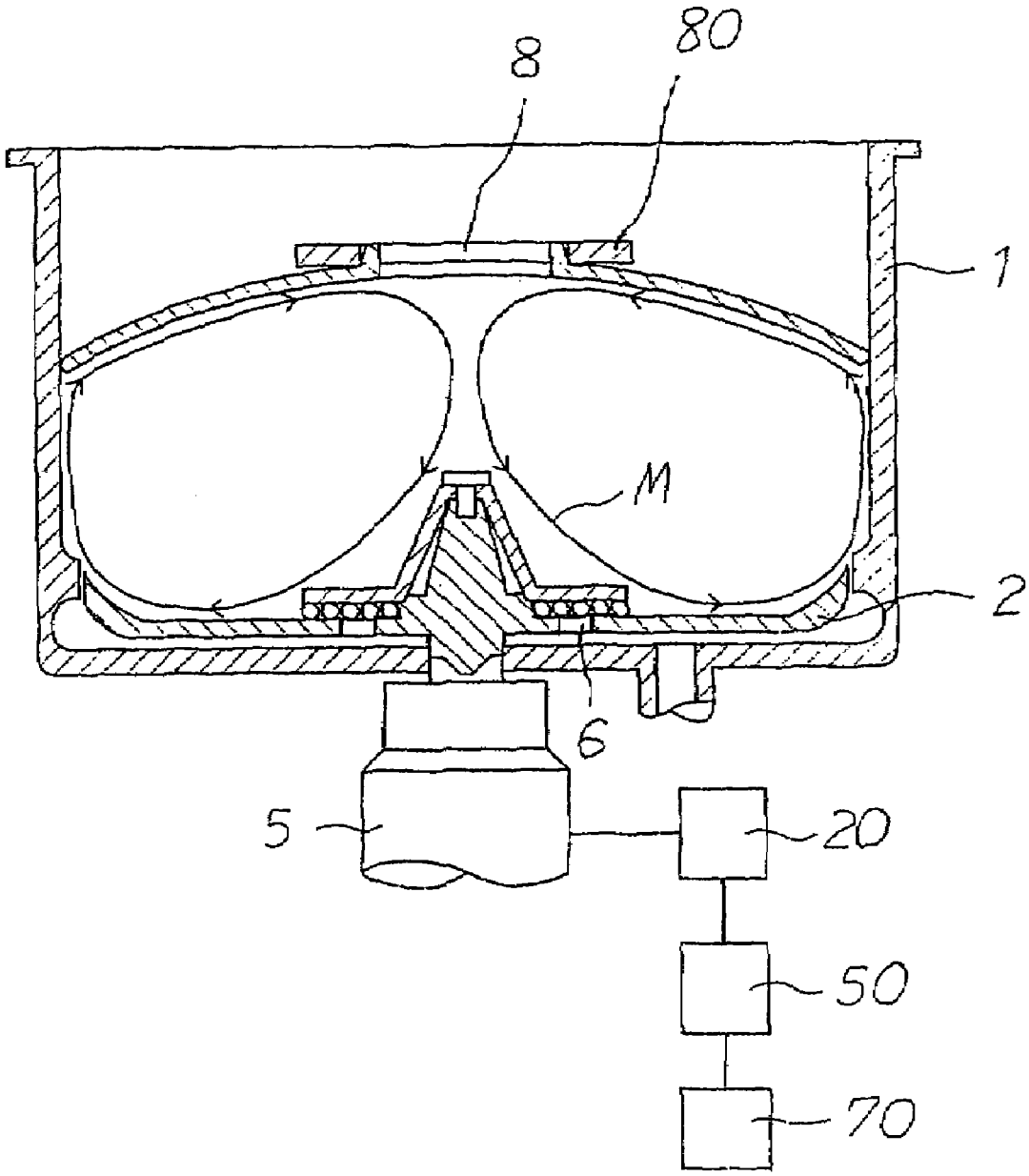
FIG. 8 is a partial cross-sectional view that depicts a fifth embodiment of the present invention.

FIG. 8 depicts a fifth embodiment of the present invention. In FIG. 8, a weight 80 is put on an upper surface of a movable means 3 that can be moved up and down within a polishing bath 1, a weight or the number of weights is increased or decreased according to changes in a load of a driving motor 20, thereby controlling a flow area of a mass M. A weight adjustment of this weight 80 may be made either automatically using a robot or the like or manually. Alternatively, the movable means 3 may be a flexible member as shown in the first embodiment, and the weight 80 may be put on the upper surface of the movable means 3, thereby bending the movable means 3 toward an interior of the polishing bath 1 and increasing or reducing a force of pressing down an upper end of the mass M.

Sixth Embodiment: Number-of-Revolutions Control

In the respective embodiments stated so far, if the load of the driving motor 20 is reduced, the position of the movable means 3 is changed to control the flow area of the mass M and to increase or reduce the pressure applied to the mass M. Besides, if the rotation speed of a rotary disc 2 is controlled to increase or decrease a flow speed of the mass M when the load of the driving motor 20 is changed, the pressure applied to the rotatably flowing mass M can be increased or reduced. Namely, according to this sixth embodiment, control means 50 for controlling the rotation speed of the driving motor 20 is allowed to function as a means for controlling a flow of the mass M. It is noted, however, an upper portion of a polishing bath 1 is covered with a lid so as to prevent the mass M from protruding when the number of revolutions of the rotary disc 2 is increased.

Seventh Embodiment: Intermittent Control

Furthermore, a control means 50 may be configured to be able to set a constraint polishing time for which a flow direction of a mass M is changed by a movable means 3 and a workpiece is polished in a constraint state, and an unconstraint polishing time for which the mass M is polished while the mass M flows freely without a change in the flow direction thereof by the movable means 3, and to intermittently control a flow of the mass M. By so configuring, it is possible to efficiently perform barrel polishing (see FIGS. 13 and 14 for a third example to be described later), similarly to the preceding embodiments.

Namely, a method according to this embodiment is a method for turning the workpiece into an unconstraint state by raising the movable means 3 up to a height at which the mass M is in no contact with the movable means 3 or the number of revolutions of a rotary disc 2 is decreased so that the mass M is in no contact with the movable means 3 without changing the height of the mass M when the workpiece constraint polishing time reaches a predetermined time. During the constraint polishing, a non-uniform mixture state of mixing up a media and the workpiece often causes a deterioration in polishing efficiency. However, by intermittently releasing the constraint and allowing the mass M to rotatably flow in a free state, the workpiece and the media are mixed together uniformly again. It is, therefore, possible to further enhance the polishing efficiency.

FIRST EXAMPLE

Elevation of Movable Means

Figure 9:
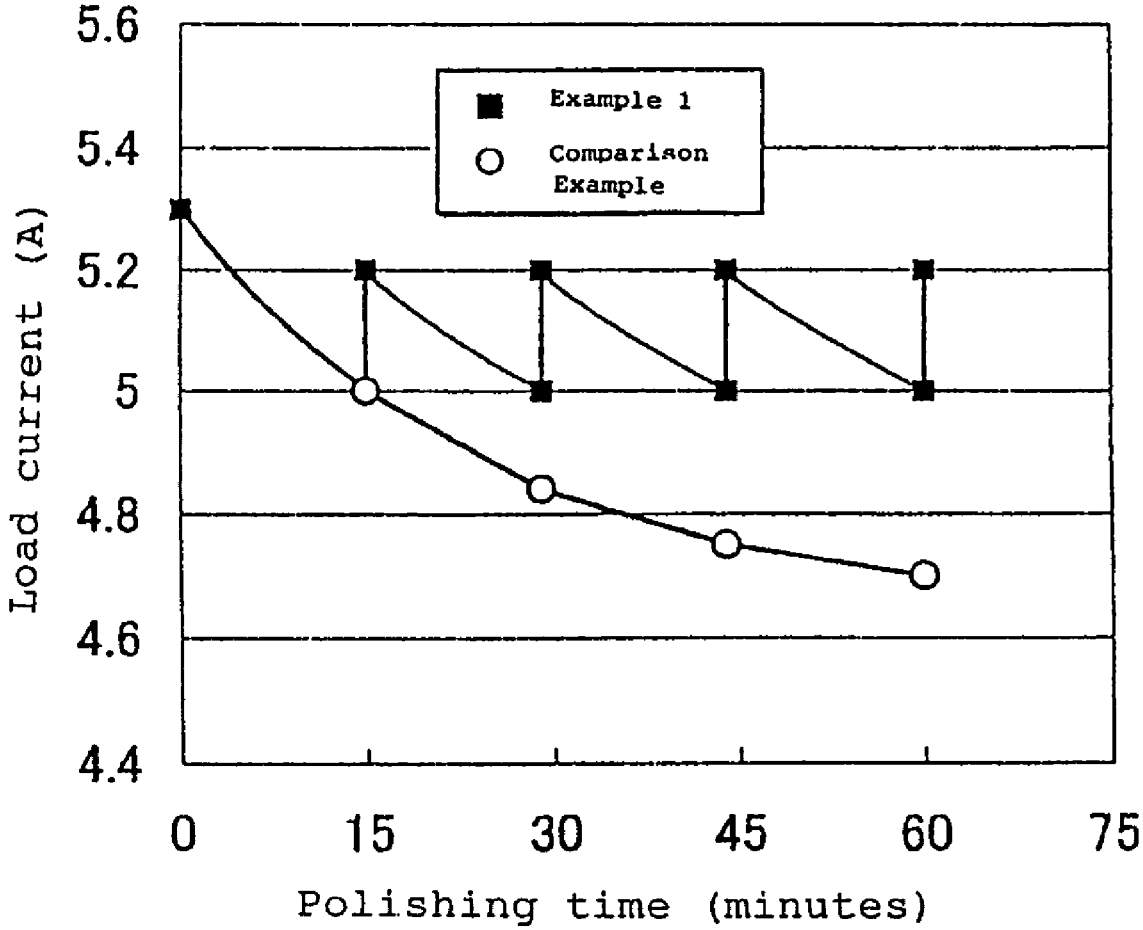
FIG. 9 is a graph that depicts a change in a load current according to a first example.

Using the barrel polishing apparatus including the polishing bath 1 having an inside diameter of 440 mm as shown in FIG. 4, the mass M that is a mixture of a triangular prism media and a test piece ① (SS400; a cylinder having a diameter of 15 mm and a length of 20 mm) serving as a workpiece is input into the polishing bath 1 at 95% relative to an internal volume of the polishing bath 1, this mass M is constrained while the flow direction thereof is changed by the movable means 3, and the barrel polishing is performed. In polishing, the number of revolutions of the rotary disc 2 is set at 350 $min^{-1}$, an upper limit of the load current of the driving motor 20 is set at 5.2 A, and a lower limit thereof is set at 5.0 A, and the height of the movable means 3 is controlled so that the load current is kept within this set range. A change in the load current with passage of the polishing time as well as a comparison example in which the movable means 3 is kept fixed is shown in FIG. 9. Namely, in the first example, the movable mean 3 is moved downward when a polishing resistance is reduced and the current is reduced to 5.0 A, and the current is, therefore, increased to 5.2 A repeatedly. In the first comparison, the polishing is continuously performed while the movable mean 3 is fixed to an initial position, and the current is, therefore, gradually reduced.

Figure 10:
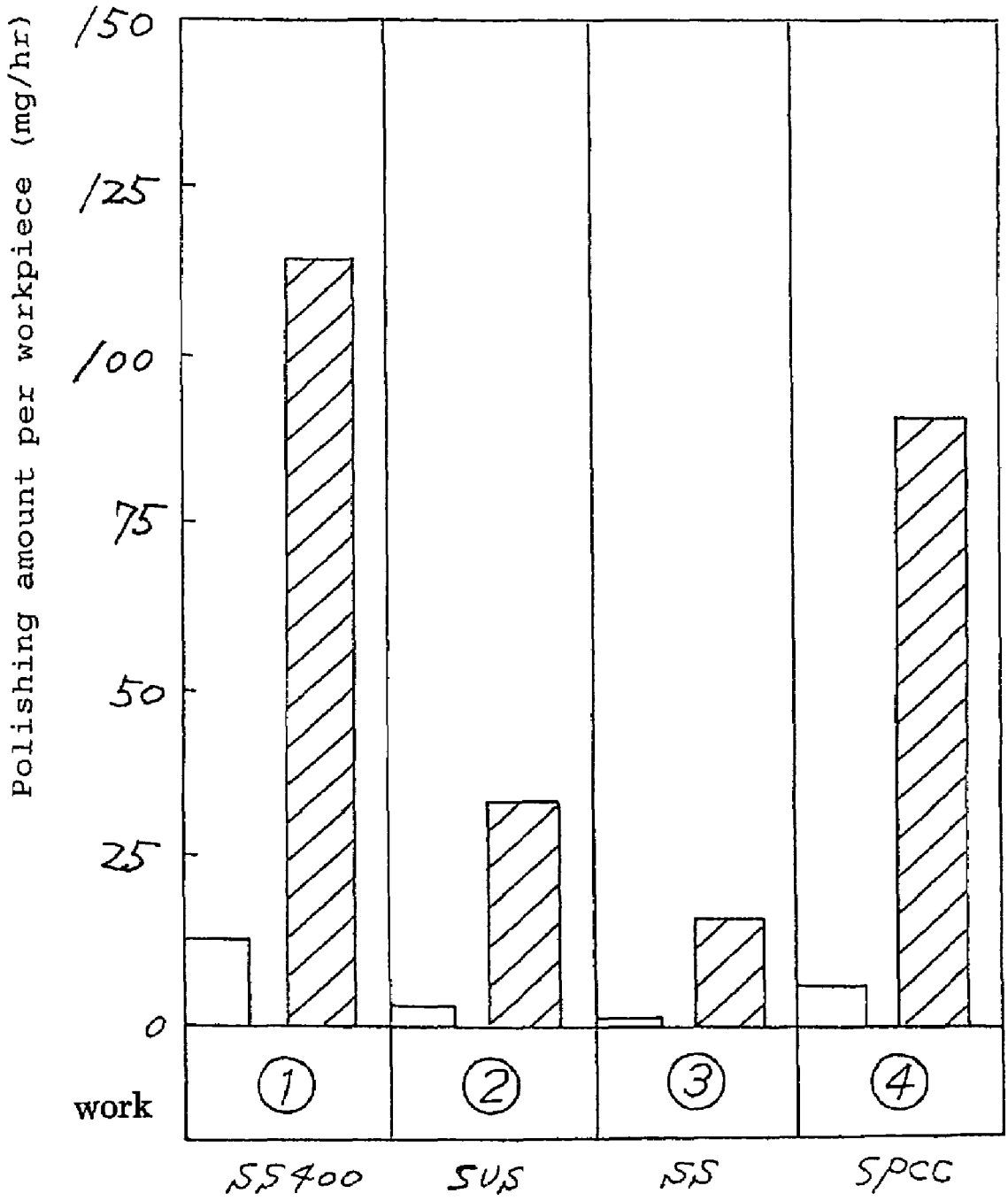
FIG. 10 is a graph that depicts a workpiece polishing effect according to the first example.

A polishing amount per workpiece is 115 mg/hr as indicated by ① in FIG. 10. In the comparison example in which the movable mean 3 is kept fixed, a polishing amount per workpiece is 13 mg/hr. Thus, the polishing amount according to the first example is 8.8 times as large as that of the first comparison example. FIG. 10 depicts examples of using the other workpieces. Data indicated by blank is data obtained when the polishing is performed with the movable means 3 kept fixed, data indicated by hatching is data obtained when the polishing is performed by the method according to the first example. Materials and sizes of the other workpieces are as follows:

②: A column of stainless steel, a diameter of three mm, and a length of 21 mm;

③: A ring of steel, an outside diameter of 14 mm, an inside diameter of 13 mm, and a thickness of 12 mm; and ④: A plate of spring steel, a length of 54 mm, a width of 27 mm, and a thickness of 4.5 mm.

Ratios of the method according to the present invention to the conventional method in the polishing amount per workpiece are: 9.9 for the workpiece ②, 14.3 for ③, and 18.6 for ④. It is thus confirmed that the method according to the present invention can enhance the polishing capability of polishing any workpiece.

SECOND EXAMPLE

Rotation Speed of Rotary Disc

Figure 11:
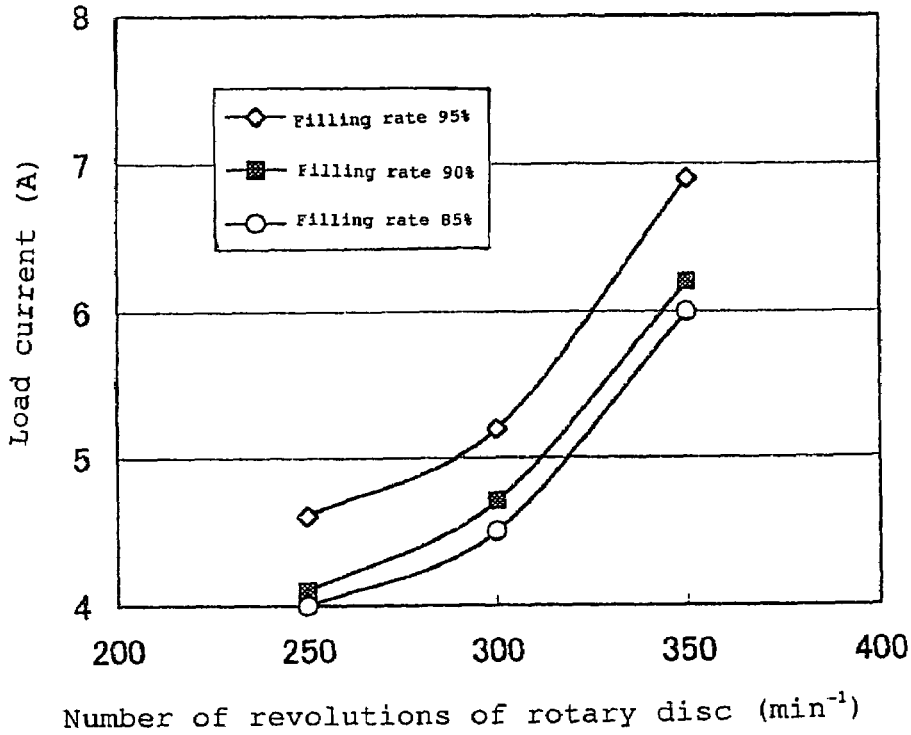
FIG. 11 is a graph that depicts a correlation between the number of revolutions of a rotary disc and a load current according to a second example.
Figure 12:
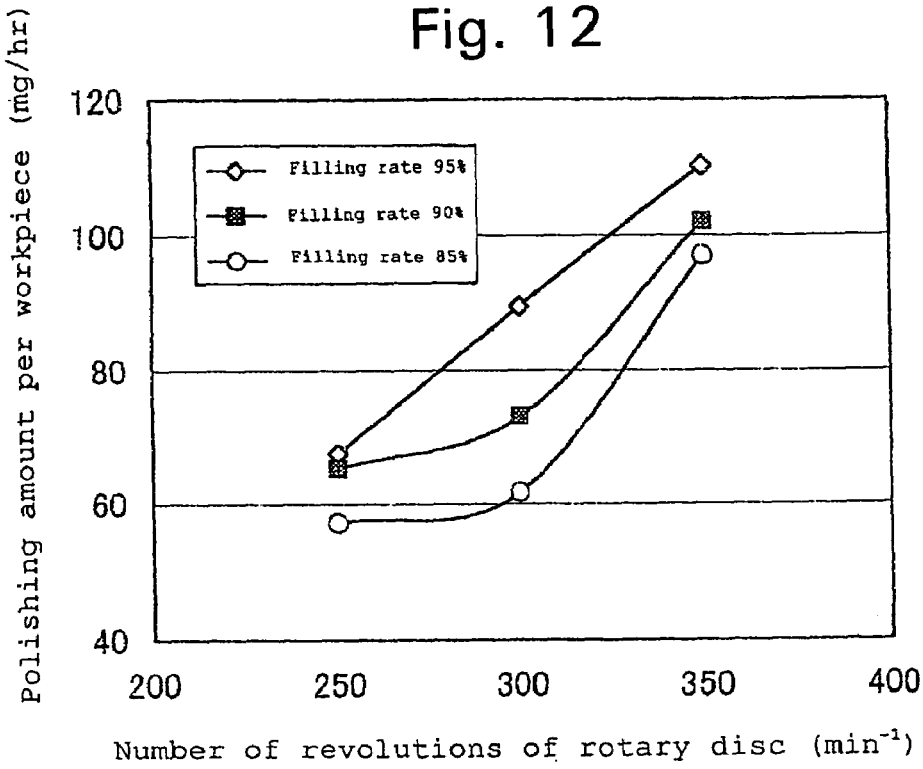
FIG. 12 is a graph that depicts a workpiece polishing effect according to the second example.

FIG. 11 depicts a result of searching correlations between the rotation speed of the rotary disc 2 and the load current of the driving motor 20 while changing a filling rate of the mass M at which the mass M is filled into the polishing bath 1 to 95%, 90%, and 85%. FIG. 12 depicts polishing amounts for the respective cases. At any filling rate of the mass M, the load current suddenly increases and the polishing amount greatly increases as the rotation speed of the rotary disc 2 increases.

Using these correlations, the load is controlled by changing the rotation speed of the rotary disc 2 between 250 and 400 $min^{-1}$. The workpiece used herein is the workpiece ① shown in the first example, and the polishing bath, the media, and the like are the same as those of the first example. The polishing amount per workpiece is over 80 mg/hr according to the present invention relative to 13 mg/hr according to the conventional method. Good results can be thus obtained.

THIRD EXAMPLE

Intermittent Control

Figure 13:
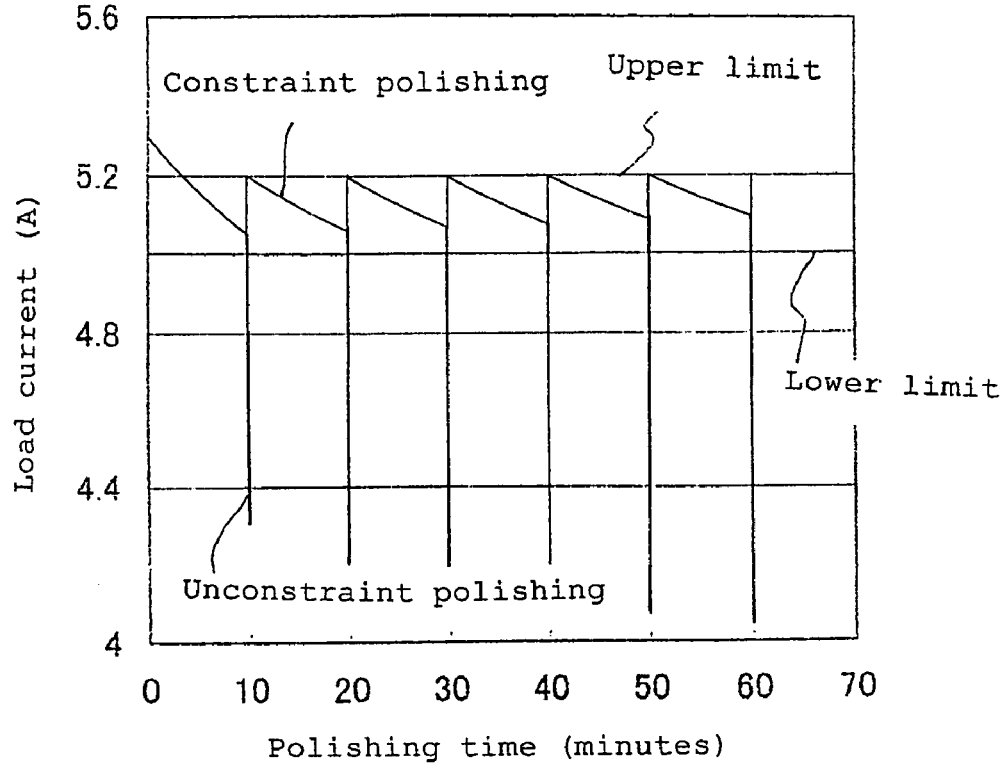
FIG. 13 is a graph that depicts a state of controlling a load current according to a third example.
Figure 14:
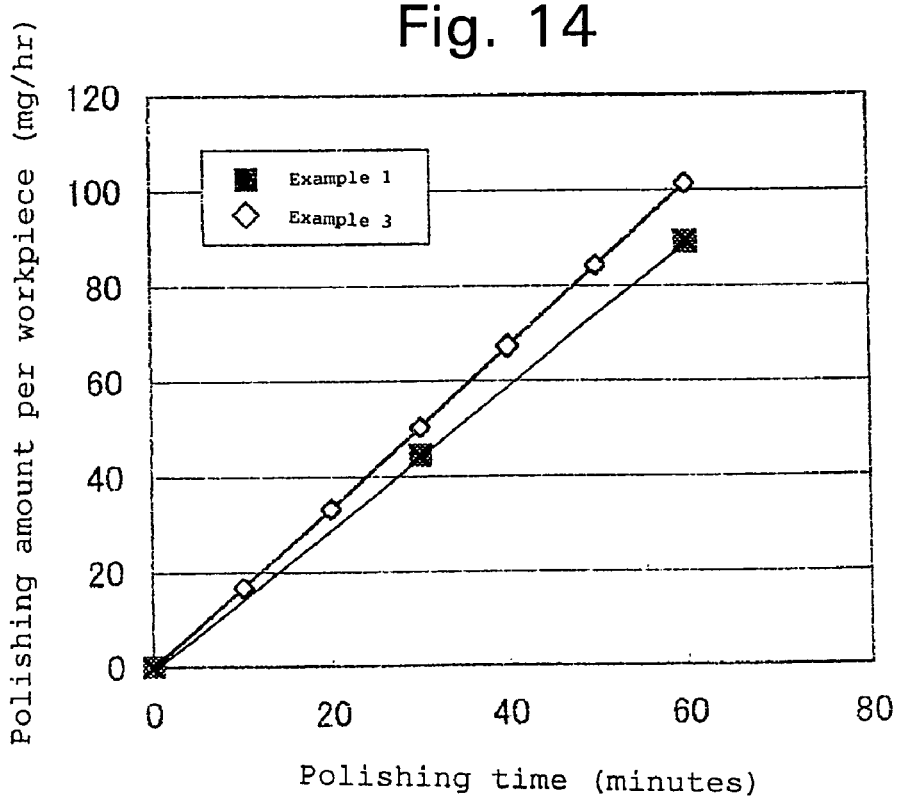
FIG. 14 is a graph that depicts a workpiece polishing effect according to the third example.

In this example, the upper limit of the load current is set at 5.2 A, and the lower limit thereof is set at 5.0 A in the same polishing conditions as those of the first example. Further, as shown in FIG. 13, one polishing cycle is set to ten minutes, in which cycle the mass M in a constraint state is polished for nine minutes and 45 seconds and the mass M in an unconstraint state is then polished for 15 seconds. By repeating the cycle, the barrel polishing is performed. As a result, as shown in FIG. 14, the polishing efficiency can be further enhanced in this third example as compared with the first example. By thus intermittently controlling the polishing, the workpiece and the media are mixed together uniformly again during unconstraint polishing. It is, therefore, possible to uniformly polish the mass M without forming scars on the workpiece surface and causing non-uniform wear.

In this third example, the mass M is intermittently controlled to freely flow by raising the movable means 3 up to the height at which the movable means 3 is in no contact with the mass M. Needless to say, the workpiece can be polished while intermittently controlling the flow of the workpiece by a method for increasing or decreasing the rotation speed of the rotary disc 2.

What is claimed:

1. A barrel polishing method for polishing a mass, comprising the steps of:

providing a polishing apparatus having a movable member elevatably moving and substantially covering an entire surface of an open portion of a polishing bath, a rotary disc positioned within the polishing bath, and a driving motor attached to the rotary disc;

disposing at least one work piece and an abrasive media in the polishing bath;

measuring a load current of the driving motor by means of applying a current to the driving motor to rotate the rotary disc, flowing the work piece and the abrasive media within the polishing bath to form a mass flow, and polishing the work piece with the abrasive media within a mass flow area; and controlling and maintaining the load current range of the driving motor to be within a preferable and predetermined load current range of the driving motor by moving the movable member toward or away from said rotary disc to adjust the mass flow area.

2. The barrel polishing method according to claim 1, wherein the mass flow area within the polishing bath is controlled and maintained by increasing or decreasing a force applied to an upper end of the mass flow area using the movable member.

3. The barrel polishing method according to claim 1, wherein the mass flow area within the polishing bath is further controlled and maintained by increasing or decreasing a rotation speed of the rotary disc.

4. The barrel polishing method according to claim 1, further comprising the step of changing the preferable and predetermined load current of the driving motor at predetermined time intervals.

5. The barrel polishing method according to claim 1, wherein the mass flow area within the polishing bath is adjusted intermittently.

6. A barrel polishing apparatus comprising:

a polishing bath containing at least one workpiece and an abrasive media;

a driving motor;

a rotary disc provided on a bottom of the polishing bath and attached to the driving motor, the rotary disc flowing the workpiece and the abrasive media to form a mass within the polishing bath;

means for measuring a load current of the driving motor;

means for setting a preferable and predetermined load current range of the driving motor for the rotary disc; and mass flow area control means for adjusting a mass flow area within the polishing bath to control and maintain the load current of the driving motor to be within the preferable and predetermined load current range wherein the mass flow area control means comprises a moveable member provided in an upper portion of the polishing bath, and an elevation mechanism for moving the movable member toward or away from said rotary disc to adjust the mass flow area.

7. The barrel polishing apparatus according to claim 6, wherein the mass flow area control means further comprises a pressurization chamber that supplies or discharges a pressurized fluid to selectively move the movable member.

8. The barrel polishing apparatus according to claim 6, wherein the mass flow area control means further controls a rotation speed of the driving motor for the rotary disc.

* * * * *